US006871454B2

(12) United States Patent
Coday, Sr. et al.

(10) Patent No.: US 6,871,454 B2
(45) Date of Patent: Mar. 29, 2005

(54) POST SHORING AND DECKING SYSTEM

(76) Inventors: Jerry F. Coday, Sr., 8371 Plum Creek Ct., Las Vegas, NV (US) 89113; Steven M. Coday, 10752 Warrior Ct., Las Vegas, NV (US) 89135

( * ) Notice: Subject to any disclaimer, the term of this patent is extended or adjusted under 35 U.S.C. 154(b) by 112 days.

(21) Appl. No.: 09/904,079

(22) Filed: Jul. 12, 2001

(65) Prior Publication Data

US 2003/0012607 A1 Jan. 16, 2003

(51) Int. Cl.[7] ..... E04G 1/20; E04G 11/48

(52) U.S. Cl. ..... 52/126.6; 182/141; 182/186.6; 249/210; 249/18; 249/28

(58) Field of Search ..... 182/182.1, 182.2, 182/182.3, 182.4, 182.5, 141, 222, 186.1, 186.6, 186.3, 186.7, 186.8; 52/126.5, 126.6; 249/28, 210, 18

(56) References Cited

U.S. PATENT DOCUMENTS

| | | | | |
|---|---|---|---|---|
| 944,373 | A | * 12/1909 | Muller | 182/186.6 |
| 3,784,151 | A | * 1/1974 | Steele | 249/28 X |
| 3,917,214 | A | * 11/1975 | Ratcliff et al. | 249/18 |
| 4,541,509 | A | * 9/1985 | D'Alessio et al. | 182/186.7 |
| 4,841,708 | A | * 6/1989 | Johnston | 52/646 |
| 4,984,654 | A | * 1/1991 | Anderson | 182/186.7 |
| 5,070,965 | A | 12/1991 | Jordan, III | |
| 5,154,256 | A | 10/1992 | Wood | |
| 5,727,650 | A | 3/1998 | Thomas | |
| 5,931,260 | A | 8/1999 | Beauchamp | |
| 5,988,317 | A | 11/1999 | Riding | |

OTHER PUBLICATIONS

Brochure—Symons Corporation Shoring Deck Support System—4 sheets, 1998.
Brochure—Etobicoke Ironworks Limited Corporate Profile—23 sheets, 1999.
Brochure—SGB Super Hi–Lite Aluminum Shoring System—8 sheets, undated.
Brochure—Doka Floor System, doka The Formwork Experts—46 Sheets, undated.
Brochure—TITAN Formwork Systems, LLC—6 sheets, undated.
Brochure—SCAFFOLD Heavy Duty Post Shores—1 sheet, Mar. 5, 2001.
Brochure—ALUMA—The new ALUMA Vertical Shoring System cuts job costs—8 sheets, undated.
Brochure—Scaffold Depot: Shoring Frames—2 sheets, Mar. 5, 2001.
Brochure—Product Bulletin C–2 AlumaSystems—Alumacs 10K Shoring System—14 sheets, undated.

* cited by examiner

*Primary Examiner*—Sunil Singh
(74) *Attorney, Agent, or Firm*—Polsinelli Shalton Welte Suelthaus PC

(57) ABSTRACT

A post shoring and decking system is for use in supporting sheet on which cement compositions can be poured. This post shoring and decking system includes a main leg member, which has a U-shaped channel, a drophead member for coupling with the main leg member and a ledger member, that is received by the drophead member.

5 Claims, 5 Drawing Sheets

Fig. 14.
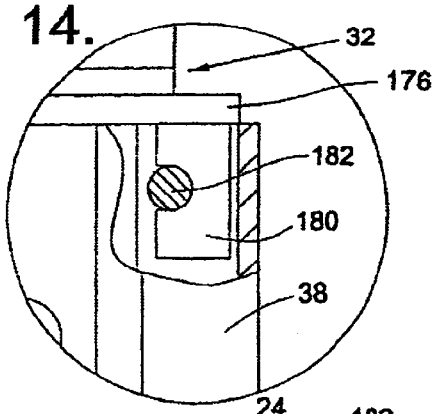
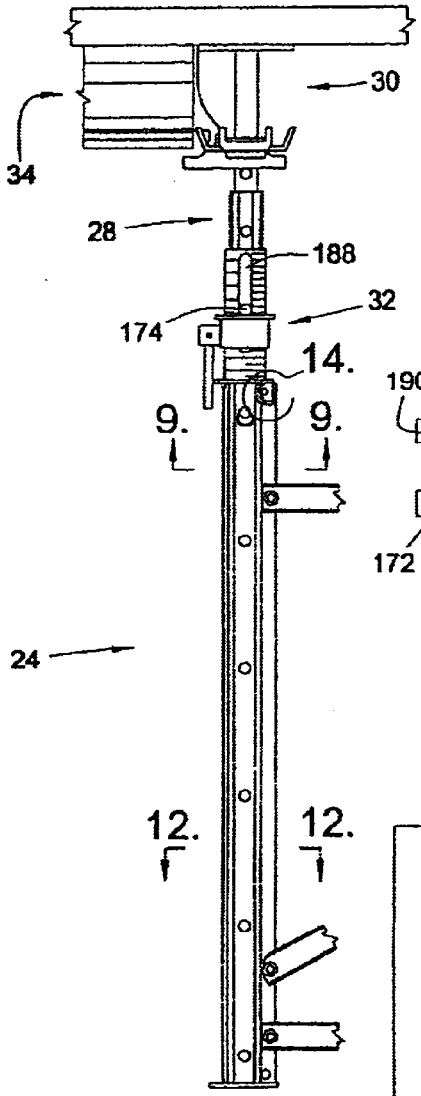
Fig. 3.
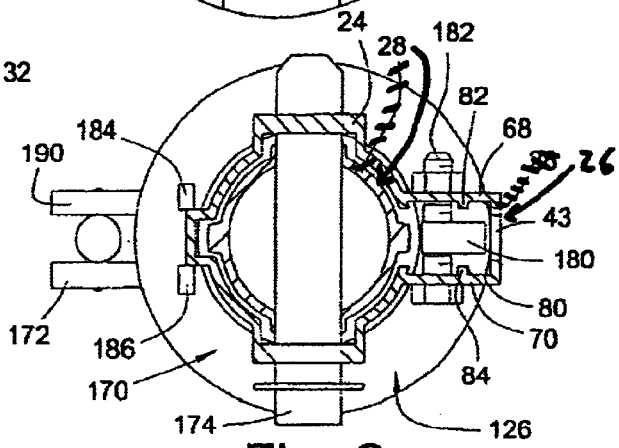
Fig. 9.
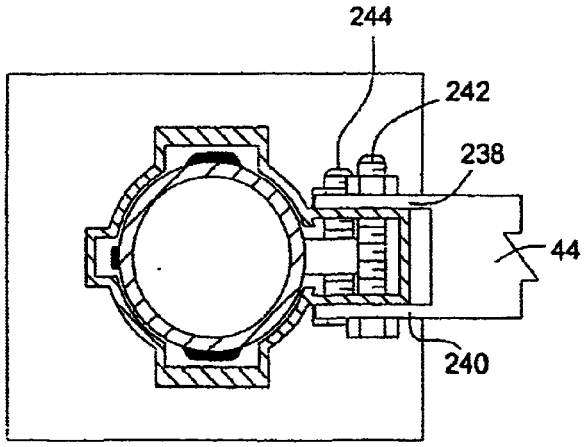
Fig. 12.

Fig. 13.
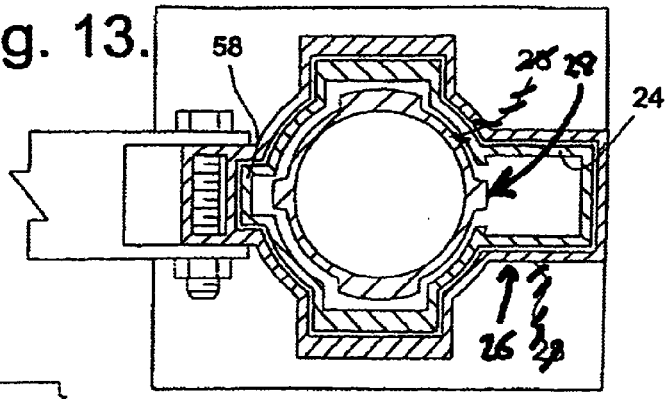
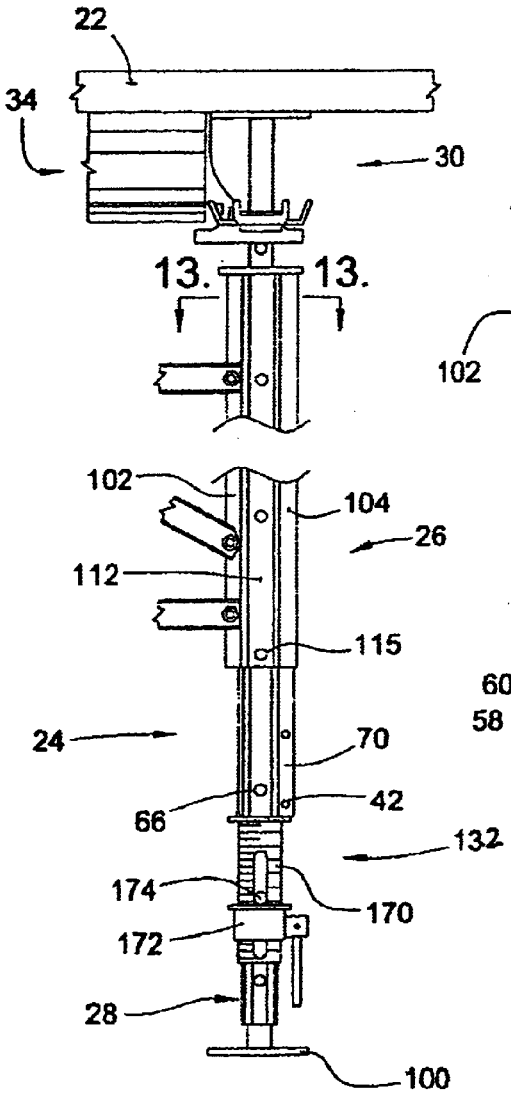
Fig. 4.
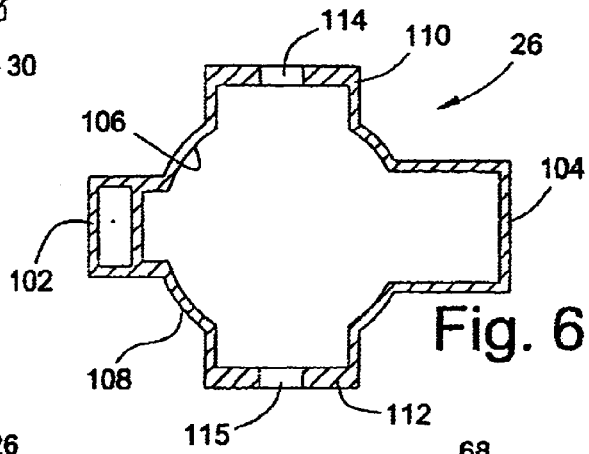
Fig. 6.
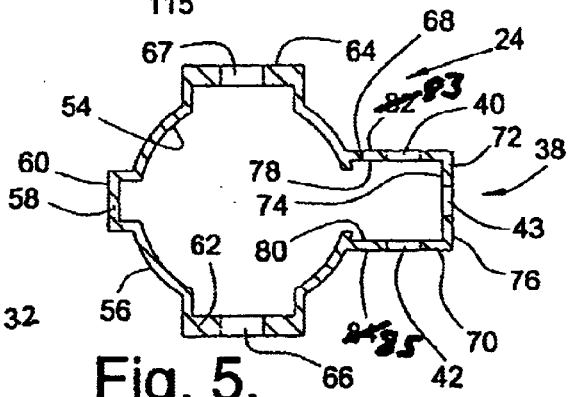
Fig. 5.
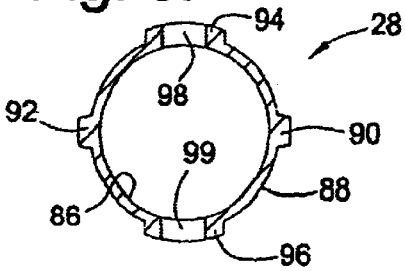
Fig. 7.

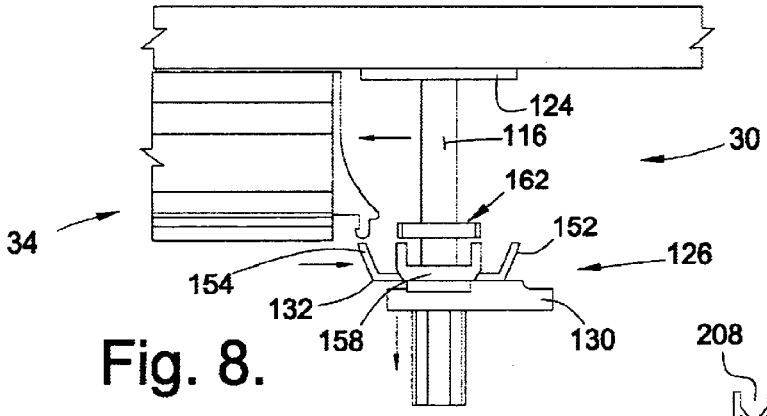
Fig. 8.
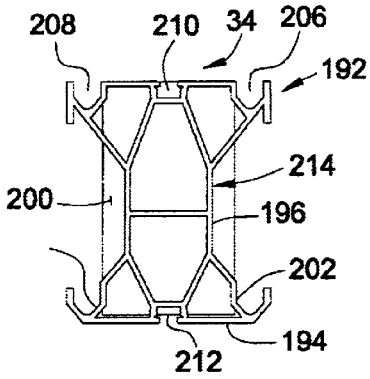
Fig. 11.
Fig. 10.
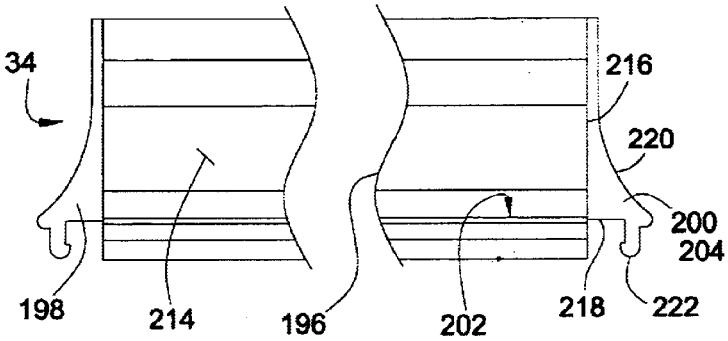
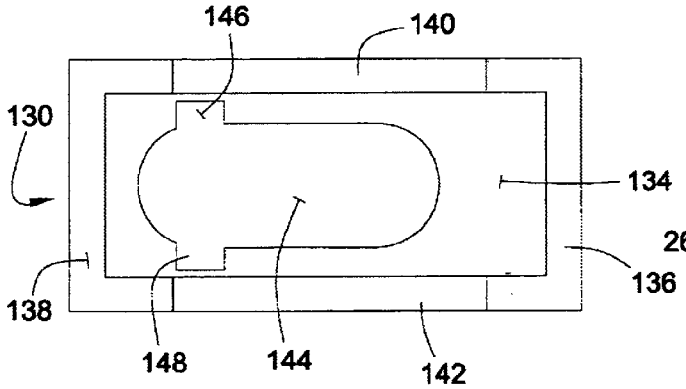
Fig. 15.
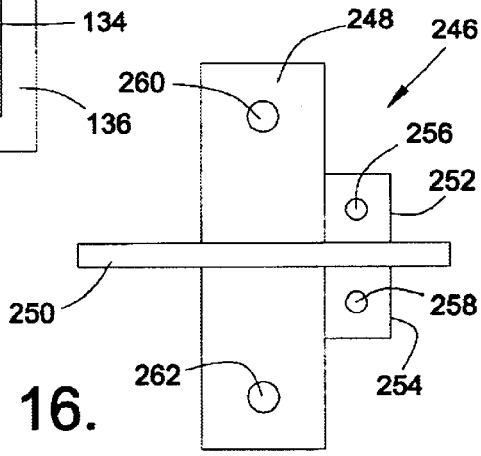
Fig. 16.

POST SHORING AND DECKING SYSTEM

FIELD OF THE INVENTION

The present invention relates to a post shore and decking system. In particular, the present invention relates to a post shore and decking system having a non-symmetrical post shore or leg and a ledger that has more than one channel and can receive a joist member at multiple locations.

BACKGROUND OF THE INVENTION

Shoring and decking systems, when assembled, form a framework suitable for use in constructing parking garages, apartments, sports stadiums, highways and a variety of other structures that are formed primarily from cement compositions. In particular, shoring and decking systems are used in the construction of structures that have cement floors or ceilings, whereby such structures have elevated flat or horizontal surfaces. Thus, the assembled shoring and decking system forms a framework on which the cement compositions can be poured and then cured. Cement compositions include compositions made of cement or concrete.

Typically, various types of shoring and decking systems are assembled from a plurality of vertical legs or post shores located proximal to one another. The post shores are used to support the cement or concrete while it cures. Post shores can also be used to support horizontal beams on which the support sheets or decking can be placed. Separate shoring frame members are used in conjunction with the post shores to form the shoring and decking system. The frame members provide a preferred structure for supporting joist or cross members on which the sheets are laid. The post shores and shoring frame members, while used together, are not fixedly or removably connected to each other.

Post shores, when in position, are leg or post devices adjustable in a vertical plane. Typically, the post shores have a flat plate member located on one end for contacting the surface of the bottom side of a floor or ceiling, or a sheet member. When in use, the post shore stands vertically. Consequently, the plate member is considered the top. A flat base member is located opposite the plate member to provide support for the post shore. This is located on the bottom of the post shore. The height of the post shore can be adjusted up or down, with the leg member that forms the post shore typically of a tubular shape. Importantly, most known post shores are stand-alone devices, which are not attached or connected in any way to other post shore members.

Most known post shores are not designed to provide a framework. As such, most shoring and decking systems have a number of different parts, which have different functions. This is disadvantageous because the parts are not interchangeable or connected and, as such, more total parts are required. This is inefficient. It is desired to have a shoring and decking system comprised of fewer parts that have multiple functions.

Another problem is that most post shores have a substantially symmetrical shape. As will be discussed, this is problematic because a curved wall is more difficult to drill a hole through. This makes it difficult to include means for attaching frame members to post shores. Also, a symmetrical leg is more difficult to align for receipt by, and attachment to, another leg. Formation of a system that easily fits together is harder to achieve. A final disadvantage is that most known post shores do not include removable means for forming a framework. For these reasons, it is desired to have non-symmetrical legs that can be easily attached to one another. It is further desired to use the post shores or legs to form the framework.

Shoring frames, or shoring systems, are used to support cross members, or aluminum beams, on which sheet or decking members can be placed. The shoring frames are typically formed from a pair of parallel vertical members connected to one another by a pair of parallel, or angled, horizontal members. Additional members can be included in the construction to increase the load bearing capacity of the shoring frame. The horizontal, or angled, cross members, which attach the two parallel vertical members are generally welded or fixedly attached to the vertical members. As such, the angled and horizontal cross members are not readily removable from the vertical members, and nearly all have welded components. For these reasons, it is desired to have a system that does not use permanently affixed or welded parts, but, instead, relies on parts that can be easily separated from one another and stored.

BRIEF SUMMARY OF THE INVENTION

The present invention relates to a post shore and decking system used to support sheets or decking members on which cement compositions can be poured. More particularly, the present invention relates to a system including a leg or post shore having a channel member which extends the length of the leg and results in the leg having a non-symmetrical construction. The invention further relates to a ledger member that has more than one channel. Included in the post shore and decking system is a drophead member used to removably attach the ledger to the leg. These three members are connected to one another to form a system, which readily supports the sheets on which cement can be poured and cured.

The post shore and decking system will be comprised of a plurality of non-symmetrical main legs each having a channel member. The channel member is typically U-shaped and extends along the entire length of the leg. Included in the channel member construction will be a plurality of holes for attachment to braces and cross members. It is preferred if the main leg has additional flat surfaces to contribute to the non-symmetrical character of the leg, as well as to provide surfaces through which holes may pass. Optimally, an extension leg member is included in the construction and can be received by, and attached to, the main leg. The extension leg member will include a plurality of aligned holes, which allow the extension leg member to be affixed to the main leg by a screw, pin, bolt, or similar attachment member. The extension leg is designed to facilitate connection of the main leg to a variety of other members of the post shore and decking system. Additionally, the extension leg is intended to aid in the adjustment of the height of the system. In order to further adjust the height of the post shore and decking system, and to allow for attachment of additional brace members, an outside leg, which fits over and is attached to the main leg, may also be included in the construction. The outside leg is of a non-symmetrical shape, and will include a channel member. Like the other legs, the outside leg will include a plurality of holes for allowing the attachment of the outside leg to the main leg, as well as to various brace members.

As stated, a drophead member is included in the construction. The drophead is designed to receive and hold a ledger member. Additionally, the drophead can be used to contact and support the sheets on which the cement is poured. The drophead is generally of a T-shaped construction and includes a mechanism for receiving and holding a ledger or joist member. When placed in a position where a ledger is in contact with the support sheets, such mechanism can be released to cause the ledger or joist to separate and move downward and away from the support sheet.

A preferred way to connect the interior extension to a leg is to use a screw collar member. The screw collar is preferred for use in the post shore and decking system because it allows for small incremental adjustment of the post shore and decking system, up or down. The screw collar can be used to adjust the decking system in increments as small as a millimeter.

A ledger is received and held by a pair of drophead members. In turn, the ledger will receive and hold a plurality of joist members. Importantly, the ledger member is comprised of opposed ends, which can be received by a drophead, and at least two channel members located either on the top or bottom of the ledger member.

The post shore and decking system can be comprised of a number of different members. Importantly, some of the members, such as the leg, are non-symmetrical. Also, the cross members, which are used to brace and stabilize the system, are not permanently affixed or welded, but, instead, can be removably attached. The post system bracing has no welded parts. This allows the system to be easily manufactured, assembled, and disassembled. These two characteristics are preferred for the system. The system further includes members that allow for the height to be adjusted between 5 feet, 10 inches and 17 feet, 6 inches as a single post system.

The present invention is advantageous because it allows for the easy adjustment, up or down, of the entire system. It also allows the system to vary in heights from 5 feet, 10 inches and 17 feet, 6 inches. The non-symmetrical character of the legs allows for easy assembly, and also provides for enhanced load bearing capabilities. The channel member is especially advantageous because it allows for the post shore or leg member to function as part of the shoring system by having non-welded brace members attached thereto. Another advantage is that the system can be easily assembled and disassembled. The ledger members are advantageous because they have up to four channels, which allow for the placement of the joist members at various locations. These and other advantages are realized from the use of the present post shore and decking system, as well as the leg and ledger members.

BRIEF DESCRIPTION OF THE DRAWINGS

FIG. 3 is a side view of the post shore, including the main leg, extension leg, screw collar, drophead, ledger, brace members, and sheet member, that form the system;

FIG. 4 is a side view of the post shore, including the main leg, extension leg, outside leg, screw collar, drophead, ledger, brace members, and sheet member, that form the system;

FIG. 5 is a top view of the main leg;

FIG. 6 is a top view of the outside legs;

FIG. 7 is a top view of the extension leg;

FIG. 8 is an exploded side view of the drophead and ledger;

FIG. 9 is a bottom view of extension leg, main leg, and screw collar;

FIG. 10 is a side view of the ledger;

FIG. 11 is a cut away front view of the ledger;

FIG. 12 is a top view of the extension leg, main leg, and brace member;

FIG. 13 is a top view extension leg, main leg, outside leg, and brace member;

FIG. 14 is a cut away side view of the screw collar tab in the main leg channel;

FIG. 15 is top view of the but plate of the drophead; and,

FIG. 16 is a side view of an extension member.

DETAILED DESCRIPTION OF THE INVENTION

Figure 1:
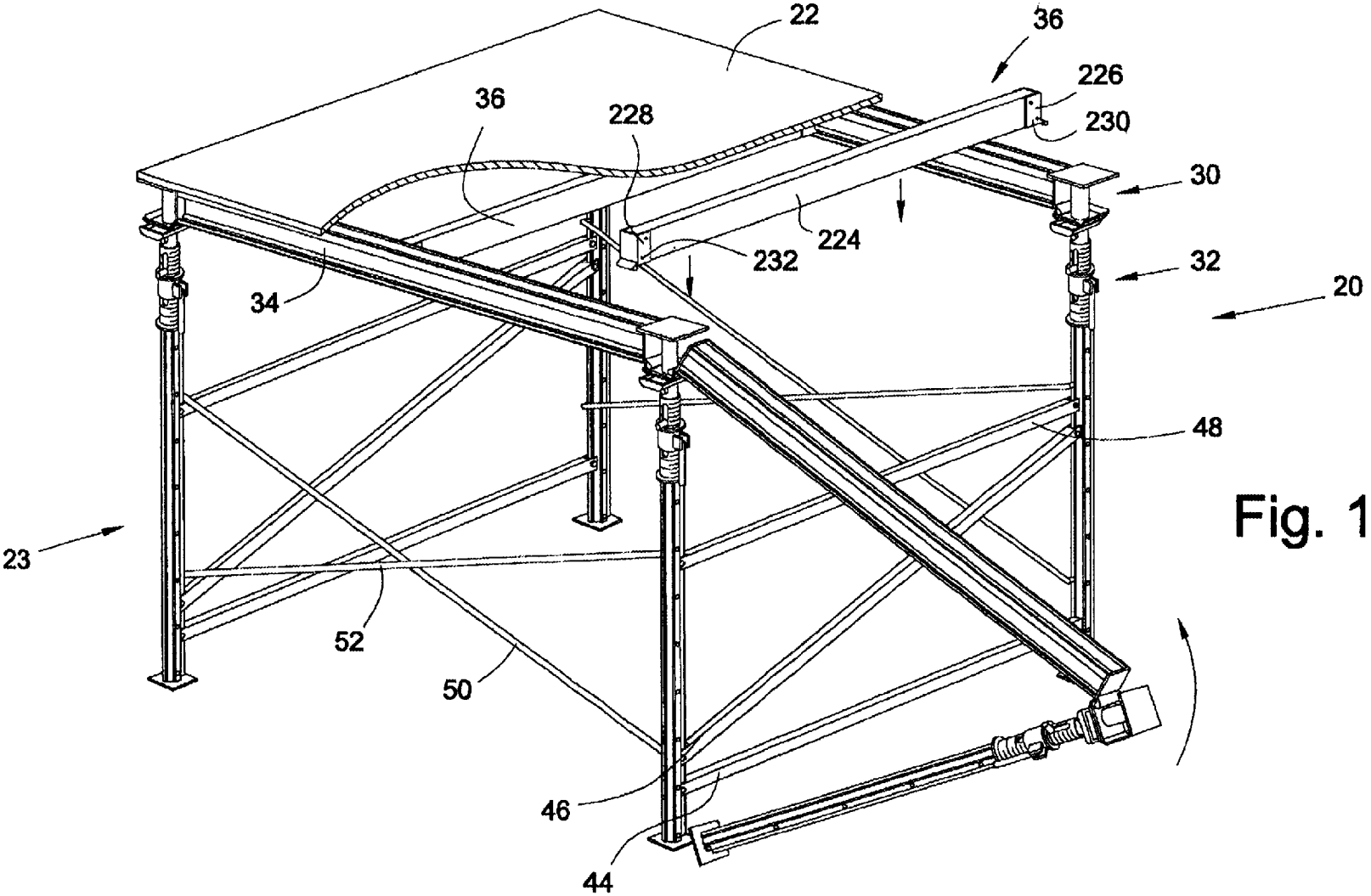
FIG. 1 is a side perspective view of a post shore and decking system, included in the drawing is a post shore, drophead, and ledger.

The present invention relates to a post shore and decking system 20, which, when assembled as shown in FIG. 1, can be used to support sheets 22 on which cement compositions can be poured to form cement slabs used in the construction of various structures. The present system 20 is comprised of a number of different members, which are readily connected to form the assembled post shore and decking system 20. Preferably the members are removably attached to each other so that the system 20 can be reduced to easily transported and handled pieces. To this end, the members are fitted so that they can be attached and held in place without the use of means for permanently affixed or welded constructions.

The post shore and decking system 20 is formed by placing a leg in a vertical plane or connecting a plurality of legs in a vertical plane. When assembled the leg or legs are known as a post shore 23, which is partially shown in FIG. 2. The post shore 23 can be attached to other post shores 23 to form the basis for the framework on which the sheets 22 will be placed. The connected post shore 23 are shown in FIG. 1. The post shore 23 includes a main leg 24, as shown in FIGS. 1, 2, 3, 4, and 5. Optionally, the post shore 23 can include an outside leg 26 shown in FIGS. 4 and 6, and an extension leg 28, shown in FIGS. 2, 3, 4, and 7. Each post shore 23 is designed to receive and support a drophead device 30, shown in FIGS. 1, 2, 3, 4, and 8. The drophead device 30 can be removably held in contact with the post shore, and, in particular, the main leg 24, by an extension leg 28 and a screw collar 32, shown in FIGS. 1–4, and 9. Individual ledgers 34, specifically shown in FIGS. 10 and 11, are removably held and retained by at least two drophead devices 30, with sheets 22 on which the concrete or cement can be poured, placed over multiple ledgers and joist members 36. The use of the ledgers 34, in combination with the joist members 36, is shown in FIG. 1.

As stated, the post shore 23, can be formed by a single leg or any of a variety of connected or attached legs. Preferably, multiple legs are removably attached to each other. The shape of the individual leg members is important to the present invention. It is necessary for the leg or legs to be at least partially non-symmetrical. The leg members can be any of a variety of shapes, as long as the main leg 24 includes a U-shaped channel 38 that extends the length of the main leg member 24. The channel 38 is necessary to allow the post shore 23, or main leg 24, to serve as the framework for the entire system 20. The channel 38 is best shown in FIGS. 3, 4, 5, and 12, will include holes 40, 42, and 43 that allow for support members 44, 46, 48, 50, and 52 to be removably attached to the main leg 24.

Because the support members 44, 46, 48, 50, and 52 can be readily attached and detached, the post shore 23 can include three different leg members 24, 26, and 28 that can be telescopically received and adjusted. In particular, the outside leg 26 can be moved and adjusted along the entire length of the main leg 24. This can only be accomplished if the framework members can be removed to allow for passage of the leg 26. The legs 24, 26, and 28 can be telescopically received and connected to each other by a pin, bolt, screw or similar member. It is important that the legs can be held together by removably attached members. Alternatively, the legs can be held to each other by an attachment device, such as a collar or connector. If held together by the attachment device, it is preferred if at least two main legs 24 are attached to each other in an end to end arrangement. Any of a variety of legs or post shores can be used, as long as the legs can receive and hold the drophead device 30. For the telescoping relationship to be used, it is preferred for the legs to be of a non-symmetrical shape. Such a shape prevents extraneous movement of the leg members relative to each other, and allows for easier alignment of holes found in the leg members. Once the holes are aligned, pins can be used to hold the legs in fixed contact with each other. As such, the legs can all be used together or multiple legs of the same construction can be used.

The preferred shape for the main leg 24 is a celtic cross shape best shown in FIG. 5. The main leg 24 has an inside wall 54 and an outside wall 56. The main leg 24 includes a lengthwise outward extending channel member 38 integrally attached thereto. Located opposite the channel 38, it is preferred for the leg to have a foot 58, which is also preferably of a U-shape. The foot will have a flat outer surface 60 and an inside wall and an outside wall. The foot 58 is designed to slidably receive part of the extension leg 28, as shown in FIG. 9. The foot 58 will also be slidably received by part of the outside leg on the outside wall of the foot, as shown in FIG. 13. The foot is preferred because it provides for increased load bearing capacity, is flat to allow holes to be easily drilled therethrough, and contributes to the non-symmetrical construction to prevent excess movement of telescopically connected legs. The foot 58 preferably has a thicker wall than the curved walls of the main leg 24.

Perpendicular to the channel 38 and the foot 58 will preferably be a pair of opposed projections 62 and 64 having flat outside and inside surfaces. The projections are integral with the leg and extend lengthwise. The projections 62 and 64 contribute to the non-symmetrical shape of the leg 24. Because the projection surfaces are not curved, it is easier to drill holes therethrough. The projections 62 and 64 will have a plurality of aligned holes 66 and 67. As mentioned, it is preferred for the projections 62 and 64, as well as the foot 58, to have walls of a thicker construction than the remainder of main leg 24. This will increase the load bearing capacity of the leg. Thus, the curved portions of leg 24 are of a lesser width. The resulting celtic cross shape of the main leg 24 is preferred because it presents multiple flat surfaces. This is advantageous because drilling holes in a flat surface is easier than a curved surface. Another advantage is that the curved wall portions can be thinner, so that the flat surface bears most of the load.

Alternative designs for the main leg 24 can be used, as long as the channel 38 is included in the construction. For example, the main leg 24 could be of a generally annular construction with the channel 38 affixed thereto.

The channel 38 has opposed side walls 68 and 70 and a front wall 72. The front wall 72 has an inside face 74 and outside face 76. Each side wall has an inside face 78 and 80 and an outside face 83 and 85. A plurality of aligned holes 40 and 42 are located in the channel side walls 68 and 70. The channel front wall 72 has a plurality of holes 43 located therethrough. The U-shaped construction of the channel 38 is preferred because it contributes to the main leg's 24 non-symmetrical character. Such a shape also allows for easy attachment and detachment of the support members 44, 46, 48, 50, and 52. The channel is important to forming a system 20 that has support members that are readily attached and detached.

It is preferred if on the inside faces 78 and 80 of the channel side walls 68 and 70 a pair of opposed tabs 82 and 84, shown in FIG. 9, are affixed. The tabs 82 and 84 extend over a substantial portion of the length of the channel 38. The tabs form a slot, which will slideably receive a nut or similar member that can be fastened to a screw passing through the front wall holes 43. Instead of tabs 82 and 84, a wall that extends the width of the channel 38 may be used, as long as a slot is formed in which the nut can slide. Other means for receiving and holding the nut may be included.

The channel 38 can be any of a variety of constructions. The channel 38 must be of a construction such that means can be used to receive and hold the support members on the channel. The channel should further contribute to the legs 24 non-symmetrical character. It is further preferred if the channel construction is such that it can receive and hold part of the screw collar 32, as shown in FIG. 14.

The main leg 24 can be of any of a variety of lengths. Preferably, the leg 24 is four (4), five (5), or six (6) feet long. Other lengths, however, may be used. The holes 66 and 67 on the main leg 24 can be of any of a variety of diameters as long as a pin, bolt, screw, or similar member can pass therethrough. Also, the holes 66 should be of the same diameter as the other holes found in the outside leg 26, for example. The holes 66 and 67 in the projections 62 and 64 should be located intermittently over the surface of the projections. Generally, such holes should be about one foot apart. Some holes 66 and 67 should be located near each end. This is done so that either the outside leg or the connector leg can be adjusted in one-foot increments. This allows for vertical adjustment of the attached legs.

Preferably, the side wall holes 40 and 42 are located near the top and bottom of the channel 38. Such a construction allows for attachment to other leg members via a leg connector. It further permits attachment to a screw collar 32 as shown in FIG. 14. It is further preferred for additional holes 40 and 42 to be located intermittently over the length of the channel 38 to allow for attachment to braces or similar members. The holes which are used for attachment of the braces are preferably located about a foot apart. The front holes 43 are located about 12 inches from each end of the main leg 24, and are located intermittently at one foot increments.

The connector, or extension leg member 28, is best shown in FIG. 7. It is slidably received by the inside wall 54 of the main leg 24. The extension leg 28 is non-symmetrical so that it is fitted to be received and moved telescopically within the main leg 24. This extension leg 28 preferably has projections or tabs 90, 92, 94, and 96, which fit into and slide in the channel 38, foot 58, and projections 62 and 64 of the main leg 24. Fitted receipt, such as this, prevents extraneous movement of the extension leg relative to the main leg. The extension leg 28 has an inside wall 86 and an outside wall 88. The inside wall 86 is annular and forms a cylinder construction. The outside wall 88 of the extension leg member 28 has two pair of opposed tabs 90, 92, 94, and 96. The tabs 90, 92, 94, and 96 are integral to the extension leg 28, with the tabs slidably received by the inside wall 54 of the main leg's 24 opposed projections 62 and 64, channel 38, and foot 58. The tabs are of a greater wall width than the rest of the leg 28 so as to provide increased load bearing capacity. Also, the tabs 90, 92, 94, and 96 are comparatively flat, making it easier to drill a hole therethrough. The tabs are of a width to slideably contact and be received by the projections 62 and 64, channel 38, and foot 58 of the main leg 24. The tabs 90, 92, 94, and 96 are located generally at 90° intervals on the extension member. One set of opposed tabs 90 and 92 has a plurality of aligned holes 98 and 99, which can be aligned with the main leg projection holes 66 and 67. The diameter of the holes in the extension leg 28 is the same as the holes found in the projections 62 and 64 of the main leg 24. There should be holes 98 and 99 located near each end of the extension leg so that it can optionally be fastened to a base member 100 or the drophead 30 near the end of the leg. Location of such holes also allows for the use of a greater length of the extension member.

The extension leg 28 is of a smaller diameter than the main leg 24. The extension leg 28 can be any of a variety of lengths, as long as it is at least two (2) feet long. It is preferred if the extension leg is about four (4) feet long.

The outside leg 26, shown in FIGS. 4 and 6, like the main leg 24, preferably has a celtic cross shape. Other shapes, however, can be used to form the leg 26. Like the main leg 24, it is necessary for the outside leg 26 to have a channel 102. The outside leg channel 102 is for attachment to the support members 44, 46, 48, 50, and 52, and is located on a side opposite the channel 38 of the main leg 24, when the main leg 24 and outside leg 26 are in contact with each other. As such, the outside leg 26 typically has a two-channel construction, with one channel 104 for sliding over the main leg channel 38, and the other channel 102 for attachment to the support members. The dual channel construction is preferred because it provides for increased load bearing capacity. Also, the flat walls of the channels 102 and 104 allow holes to be easily drilled therethrough and contribute to the non-symmetrical construction to prevent excess movement of telescopically connected legs. The outside leg 26 includes an inside wall 106 and an outside wall 108. Perpendicular to the channels 102 and 104 will be a pair of opposed flat walls 110 and 112. The walls 110 and 112 contribute to the non-symmetrical shape of the leg 76. Also, surfaces 110 and 112 are not curved and are easier to drill holes through. The walls 110 and 112 will have a plurality of aligned holes 114 and 115. Finally, it is preferred for the walls 110 and 112, as well as the channels 102 and 104, to have walls of a thicker construction than the remainder of leg 26. This will increase the load bearing capacity of the leg.

As mentioned, the outside leg 26 can be affixed and attached to the support members 44, 46, 48, 50, and 52. This is partially shown in FIGS. 4 and 13. Like before, the support members are removably attached. A bolt, screw, pin, or similar member can be used to attach the support members to the channel 102 of the outside leg 26. FIG. 13 not only shows attachment of a support member to the outside leg 26, but shows the extension leg 28, main leg 24, and outside leg 26 in a telescoping relationship.

The walls that form any of the legs should be of a thickness sufficient to impart adequate strength to the system 20. Generally, the width of the walls will range from between 0.10 inches to 0.50 inches.

The drophead 30 is designed to facilitate attachment between the main leg 24 and the ledger 34. The drophead 30 has a construction whereby it is removably received and held by any of the legs 24, 26, or 28. Preferably, the drophead 30 is slidably received by the extension leg 28, with the drophead removably attached thereto. The drophead 30 is further designed to receive and hold at least two ledger members 34, as shown in FIG. 1. Alternatively, the drophead can receive and hold a joist member or members 36. As such, the drophead 30 can have any of a variety of constructions, as long as it can be easily received and held by the legs of the post shore 23, and can receive and hold at least two ledgers 34 or joist members 36. The drophead 30 is further important because it functions to release the ledger or joist from contact with the support sheets 22.

The drophead member 30 is made preferably from a tube 116 having at least one set of aligned holes 118. The tube 116 is of a diameter such that it is slideably received by the extension leg 28 or an outside leg drophead adapter. The holes 118 in the drophead 30 can be aligned with the holes 98 and 99 in the extension leg 28 so as to allow a pin member to be passed therethrough to hold the drophead in contact with the leg. The tube 116 should range between one-foot and three-feet in length and be of a diameter smaller than the diameter of the extension leg. The drophead tube 116 has a top 120 and bottom 122, with the bottom received by the extension leg 28, all shown in FIG. 2. The drophead has a square shaped platform member 124 located on the top end 120 of the drophead opposite the bottom 122. The platform 124 can be any of a variety of sizes, as long as the ledger can be contacted by the edge of the platform and held in a position suitable for supporting the sheets 22.

The drophead 30 includes a construction 126, shown in FIG. 8, for receiving and holding part of the ledger 34. The construction 126 for receiving the ledger is located between the platform 124 and the bottom of the tube 122. Any of a variety of constructions may be used as long as the ledger 34 can be held in place.

Preferably, the drophead 30 will include two outward extending projections 128 located between the holes 118 and the platform 124. The projections 128 are designed to hold the ledger receiving construction 126 in an elevated position when the drophead is in a position for engaging a ledger 34.

Figure 2:
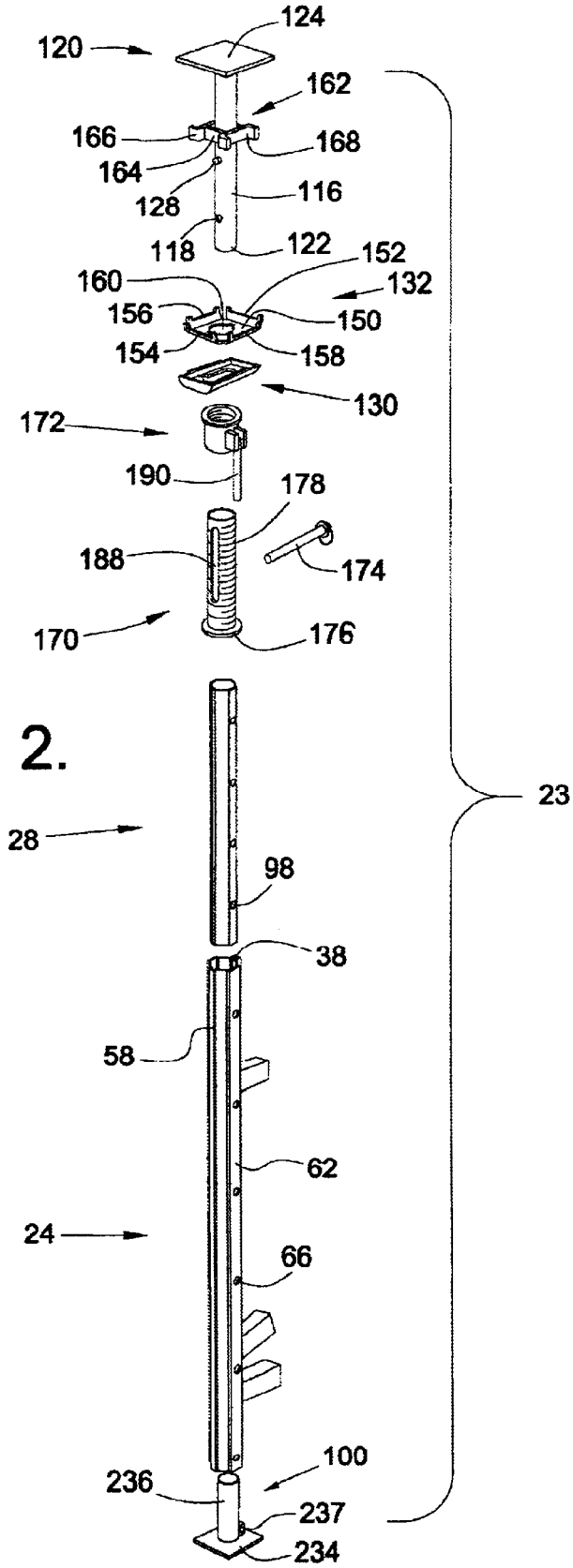
FIG. 2 is an exploded side perspective view of the post shore, screw collar, and drophead.

The preferred ledger receiving construction 126 includes a bent plate 130, shown in FIGS. 2 and 15, and a support plate 132, shown in FIG. 2. The bent plate 130 is of a rectangular construction having a base member 134 with two pair of integral curved opposed side walls 136, 138, 140, and 142. Side walls 136 and 138 are located on each end of the base member 134. Side walls 140 and 142 are located along the sides of base member 134 are of a greater height than side walls 136 and 138, which is preferred in order to stop excessive movement by either the bent plate or support plate 132. The bent plate base member 134 includes a slot 144 for moving the bent plate horizontally about the axis of the tube 116. The slot 144 of the bent plate 130 will include two opposed cuts 146 and 148 perpendicular to the slot 144 that allow the bent plate to slide over and past the two projections 128. Once the bent plate 130 has been moved upward past the projections 128, the bent plate can then be moved perpendicular to the tube 116 along the slot 144 to be held in place. When engaged, the bent plate 130 can be disengaged by moving the plate horizontally until the cuts 146 and 148 are located over the projections 128, which will result in the bent plate moving or falling downward, illustrated in FIG. 8. This, in turn, causes the support plate 132 in contact with the ledger 34 to move down, and results in the ledger 34 disengaging from the sheets 22.

Located between the platform 124 and the bent plate 130 will be the support plate 132 best shown in FIG. 2. The support plate 132 is generally of a square construction, with it comprised of a base member 150 and two pairs of opposed tabs 152, 154, 156, and 158. The tabs 152, 154, 156, and 158 are integral to the base member 150 and curve away from the support plate. When in position the tabs curve upward. The tabs 152, 154, 156, and 158 can be of a solid construction or can have a portion cutout to form a U-shaped structure. The cutout is located on the tabs opposite the base. The tabs will contact part of the ledger 34, when in place, and prevent the ledger from slipping out of contact with the drophead 30. The curved construction of the tabs forms a fitted construction with the ledger. A slotted hole 160 is designed to allow passage of the support plate over the two projections 118 on the tube 116.

A support plate stop 162, shown in FIG. 2, will contact the support plate 132, with the support plate stop located between the support plate 132 and the platform 124. The support plate stop 162 is formed from two pair of attached legs 164, 166, and 168, which are affixed to the tube 116. The support plate stop 162 prevents the upward movement of the support plate 132. Generally, one set of opposed legs are U-shaped 166 and 168, and the other pair 164 is substantially straight.

The screw collar 32 is a nut 170 and bolt 172 arrangement designed to move a pin 174 up or down, and is shown in FIG. 2. More particularly, the screw collar 32 is used to adjust the drophead 30, or a leg, up or down. One way this is accomplished is by attaching the drophead 30 to the extension leg 28 with the pin 174 that holds the drophead in contact with the extension leg 28 also being in contact with the nut member 172 of the screw collar 32. The nut 172 can be actuated on the screw 170, up or down, thereby, in turn, moving the drophead 30 or leg 28 up or down. Alternatively, the screw collar 32 can be attached to the extension leg 28, which is attached to the base 100, as shown in FIG. 4. The opposite end of the screw collar 32 is attached to the main leg 24. As such, the screw collar 32 moves the main leg 24 up or down near the bottom of the system, as opposed to the top. Any of a variety of constructions can be used, as long as the drophead 30 can be affixed to either the main leg 24 or the outside leg 26, and can receive and hold the extension member 28 and/or drophead so as to move the drophead 30 up or down. It is also preferred for the screw collar 32 to be removable.

It is preferred for the bolt 170 of the screw collar 32 to have a cap 176 and a threaded member 178. The cap 176 will be placed in contact with the main leg 24, as shown in FIG. 9, or the outside leg 20. The cap 176 has a tab 180 shown in FIG. 14, which is located on the cap opposite the threaded member 178. The tab 180 is designed to be received by the channel member 38 of the main leg 24. The tab 180 can also be received by the channel member 104 of the outside leg. The tab 180 is constructed such that a bolt or a pin 182 is placed in contact with the tab and passed through one or a pair of aligned holes of the channel to hold the screw collar 32 in place. Thus, the tab 180 is notched, as shown in FIG. 14. Located on the hat 176 opposite the tab 180 will be a pair of punch stops 184 and 186. The stops 184 and 186 are small projections intended to fit or contact the outside wall of the foot 58 opposite where the tab 180 contacts the channel 38. The stops 184 and 186 limit movement the screw collar when it is in contact with the leg. The cap 176 is integral to the threaded bolt member 178. The bolt member 178 is threaded so that the threaded nut 172 can rotate thereon. Any of a variety of diameters can be used in association with the bolt member 178, as long as the extension member 28 and/or the drophead 30 can be placed in or held by the interior of the screw collar 32. The bolt member 178 will have an outside wall and an inside wall, and is generally of a cylindrical construction. Additionally, the bolt member 178 has a pair of opposed slots 188 located therein. The slots are of a width sufficient to allow the pin 174 to pass therethrough. The slots can be any of a variety of lengths as long as they are slightly shorter than the length of the screw collar 32. The slot 188 will generally be less than a foot in length so that small incremental adjustments can be made.

The nut 172 is threaded to be received and rotate on the screw member 178. It is preferred if the nut 172 has a handle 190 to facilitate the rotation of the nut on the screw member. Thus, when in use, the nut 172 is in contact with pin 174 that is holding the drophead 30 in contact with the extension leg 28, so that when the nut is actuated, the drophead can be raised or lowered in small increments.

The ledger 34, best shown in FIGS. 10 and 11, can have any of a variety of constructions, as long as it can be received and held by the drophead 30. Also, the ledger 34 must have a construction, whereby the joist 36 is received and held by the ledger 34. It is preferred if the ledger 34 can receive the joist 36 on either side and on the top 192 or bottom 194. The ledger is preferably a beam 196 having a channel or catch on the top 192 and the bottom 194 and on each side. A pair of opposed ledger catches 198 and 200 are located on each end of the beam 196. Located on the bottom half 194 of the ledger, on each side, will be a pair of channels 202 and 204 for receiving the joist. A pair of channels 206 and 208 are also located on each side of the top half 192 of the beam 196. The top 192 and bottom 194 will have reservoirs 210 and 212 that extend the length of the beam. It is preferred if the waist 214 of the ledger is comparatively narrow. More preferably, the ledger waist 214 will be ⅓ of the ledger's total width.

The channels 202, 204, 206, and 208 are advantageous because they provide multiple locations on which the joist can be held. The channels can have constructions other than that shown so long as a joist member can be received and held.

Attached to each end of the ledger 34 will be a ledger catch member 198 and 200. The ledger catches are of a triangular-like construction. Each has an inside wall 216, a base 218, and an outside wall 220. The inside wall 216 is affixed to the end of the ledger. The outside wall 220 is sloped. Extending away from the base is a comma-shaped foot 222. The ledger catch is designed to be received by the drophead.

The joist member 36, shown in FIG. 1, is formed from a board or similar member 224 and two opposed ledger catches 226 and 228. The joist ledger catches 226 and 228 are described above. The joist ledger catches 226 and 228 are each affixed to a U-shaped member 230 and 232. Each end of the board 224 is received by a U-shaped member 230 and 232 and affixed thereto by screws or similar fastening devices. The ledger catches will be attached to each end of the board. The joist member can be any of a variety of lengths, as long as it can be received and held by a pair of parallel ledgers. As such, the joist 36 will typically be placed perpendicular to the ledger. Generally, it is preferred if the joist is approximately 6 feet long. This is the same as the distance between two connected post shores 23. However, if the post shores 23 are is located farther apart, then the joist 36 will be of a longer construction.

The system 20 preferably includes a base plate 100 on which the leg system can be mounted. The base plate 100 can be of any of a variety of constructions, as long as it can receive and hold the leg system. The base plate preferably has a flat base member 234 and a vertically extending tubular member 236, shown in FIG. 2. It is preferred for the tubular member 236 to be integrally attached to the flat base member 234. The flat base 234 should have a diameter greater than the tubular member 236. The tubular member 236 can, in the alternative, be of a non-symmetrical shape. Any shape can be used that allows the post shore 23 to be slidably received. The tubular member 236 can be any of a variety of heights. Generally, the tubular member is between about 2 inches to about 6 inches in height. The tubular member will have a lesser diameter than the legs of the post shore.

In the base plate construction, a tab 237 can be affixed to the tubular member 236. The tab 237 will include a hole so that a screw or pin can pass through the tab hole and a pair of holes found in the main leg channel. This permits a unique way of affixing the post shore to the base plate 100, which allows a screw jack to be inserted in the base plate and fit up into the main leg, which gives unlimited fine adjustment and grading capabilities.

The system 20 can include a leg connector 246. The leg connector preferably has a tubular construction 248, with a perpendicular plate 250 integrally affixed thereto. The plate 250 is located midway between the ends of the tube 248. The connector 246 can include a pair of tabs affixed 252 and 254 to the perpendicular plate, with the tabs each having a hole 256 and 258. The tabs 252 and 254 will be received by the channel 38. A pin can be passed through the channel holes and tab holes 256 and 258 to hold the connector 246 in contact with the legs. The connector has a top and a bottom, with each having a pair of opposed holes 260 and 262.

The post shores 23 are held together and supported by a plurality of frame members 44, 46, 48, 50, and 52, as shown in FIG. 1. The frame members are attached to the main leg 24 or outside leg 26 and form a scaffolding system. This is done to support the legs and prevent them from tipping over. Any of a variety of construction can be used as frame members, as long as the frame member can be removably attached to the post shore and can provide support. Preferably, the frame members can be pinned or bolted to the channels 38 or 102 of either the main leg 24 or outside leg 26. The preferred construction is a hollow rectangular member 44, 46, and 48 having tabs 238 and 240 on each end, with the tabs 238 and 240 having aligned holes. The holes can be aligned with the channel side wall holes 40 and 42, for example, to allow a pin, screw, or bolt 242 and 244 to pass therethrough and hold the channel in contact with the support member, as shown in FIG. 12. An alternative construction includes a tubular member 50 and 52 attached to a bolt projecting away from the channel front 72. The bolt is held in place by a nut in contact with the inside face 74.

The system 20 includes a plurality of sheet or decking members 22, which are placed on top of the joist members 36 and ledgers 34. The sheet members 22 will be of a sufficient width to be held by two parallel joist members 36. The sheet should also be of a sufficient thickness to support an amount of cement poured thereon.

The system members can be made from any of a variety of materials. It is most preferred if it is made from aluminum or a similar metal.

Thus, there has been shown and described a device relating to a post shore and decking system which fulfills all the objects and advantages sought therefore. It is apparent to those skilled in the art, however, that many changes, variations, modifications, and other uses and applications to the post shore and decking system are possible, and also such changes, variations, modifications, and other uses and applications which do not depart from the spirit and scope of the invention are deemed to be covered by the invention, which is limited only by the claims which follow.

What is claimed is:

1. A post shore and decking system used to support sheets on which cement compositions can be poured, comprising:

(a) A plurality of hollow, celtic cross shaped main legs, each main leg including an inside wall and an outside wall, a lengthwise outward extending channel integrally attached to each of said legs, said channel being U-shaped and having opposed side walls and a front wall, a plurality of aligned holes located in said channel side walls, said channel front wall having a plurality of holes located therethrough, a foot that extends lengthwise being located opposite said channel, opposed flat projections are located on said outside wall of each of said main legs, said projections extending lengthwise and are perpendicular to said channel, said projections having a plurality of aligned holes;

(b) a plurality of non-symmetrical extension leg members, each of said extension leg members is slideably received by one of said main legs, said leg extension member contacting said main leg inside wall, said extension leg member has an outside surface and an inside surface, with said outside surface having two pair of opposed substantially flat projections, which are received by said main leg inside wall, said projections are located at 90° intervals on said extension leg member and are integral with said extension leg member, one set of said projections have a plurality of aligned holes, which can be aligned with said main leg flat projection holes;

(c) a plurality of outside legs, each of said outside legs having a celtic cross shape, an inside wall, and an outside wall, with said outside leg configured to slide over said main leg outside wall, each of said outside legs having a pair of opposed channels and a pair of opposed flat projections, said outside leg has a plurality of aligned holes located on said outside leg flat projection, said outside leg including a channel located opposite said main leg channel when said outside leg is positioned over said main leg;

(d) a plurality of drophead members, each comprised of a drophead tube having at least one set of aligned holes, said drophead tube is received by said extension leg member, whereby holes in said drophead tube align with holes in said extension leg member, allowing a pin member to pass therethrough and hold said drophead member in contact with said extension leg, said drophead member having a square shaped platform member located opposite said drophead member bottom, located between said platform and drophead member bottom is a member for holding a ledger member;

(e) a plurality of screw collar members, each of said screw collar members is removably received and attached to said main leg, each of said screw collar members is removably attached to said extension leg member, each of said screw collar members is formed from a nut member and threaded bolt member so that when said nut member is moved on said bolt member, said extension leg is moved relative to said main leg;

(f) a plurality of ledger members, each of said ledger members is received and held by said drophead member, each of said ledger members is comprised of opposed ends and a top portion and a bottom portion, said ledger member having a pair of parallel channels attached to said bottom portion and a pair of parallel channels attached to said top portion, and a pair of opposed catches are located on each end;

(g) a plurality of joist members, each of said joist members is comprised of a beam and a pair of opposed ledger catches located on each end of said beam, each of said joist members is receivably held by a pair of said ledger members; and, (h) a plurality of frame members, which are removably attached to one of said main leg or said outside leg.

2. The system of claim 1, wherein said system additionally includes, a base plate comprising a square plate having a vertically extending member integrally attached thereto, said base plate for receiving and holding said main leg.

3. The system of claim 1, wherein said system additionally includes, a leg connector of a tubular construction, a perpendicular plate located near the middle of said connector, a pair of opposed tabs attached to said plate, each of said tabs having a hole, said tabs being received by said main leg channel, so that said tab holes and channel side wall holes are aligned and a pin can pass therethrough.

4. The system of claim 1, additionally including a plurality of sheet members for placement on top of said joist members.

5. A post shore and decking system used to support sheets on which cement compositions can be poured, wherein said system comprises:

(a) a hollow, celtic cross shaped main leg, said main leg having an inside wall and an outside wall, a lengthwise outwardly extending channel integrally attached to said main leg, said channel being U-shaped and having opposed side walls and a front wall, a plurality of aligned holes located in said channel side walls, said channel front wall has a plurality of holes located therethrough, a foot that extends lengthwise located opposite said channel, opposed flat projections located on said outside wall of said main leg, said projections extend lengthwise and are perpendicular to said channel, said projections have a plurality of aligned holes;

(b) a non-symmetrical extension leg member, said extension leg member is slideably received by said main leg, with said extension leg member contacting said main leg inside wall, said extension leg member has an outside surface and an inside surface, with said outside surface having two pair of opposed substantially flat projections, which are received by said main leg inside wall, said flat projections are located at 90° intervals on said extension leg member and are integral with said extension leg member, one pair of said flat projections having a plurality of aligned holes, which can be aligned with said main leg flat projection holes;

(c) an outside leg having a celtic cross shape, an inside wall, and an outside wall, with said outside leg designed to slide over said main leg outside wall, said outside leg having a pair of opposed channels and a pair of opposed flat projections, said outside leg having a plurality of aligned holes located on said flat projections, said outside leg including a channel located opposite said main leg channel when said outside leg is positioned over said main leg;

(d) a drophead member comprised of a tube having at least one set of aligned holes, said tube received by said extension leg, said holes in said drophead tube for aligning with holes in said extension leg, allowing a pin member to pass therethrough and hold said drophead in contact with said extension leg member, said drophead including a square shaped platform member located opposite a bottom portion of said drophead member, a member for holding a ledger member located between said platform member and said bottom portion;

(e) a screw collar member, said screw collar member being removably received and attached to said main leg, said screw collar member being removably attached to said extension leg member, said screw collar member is formed from a nut member and threaded bolt member so that when said nut member is moved on said bolt member, said extension leg member is moved relative to said main leg;

(f) a ledger member, said ledger member for being received and held by said drophead member, said ledger member comprised of, opposed ends and a top and a bottom, said ledger member including a pair of parallel channels attached to said bottom and a pair of parallel channels attached to said top, a pair of opposed catches are located on each end;

(g) a joist member comprised of a beam and a pair of opposed ledger catches located on said beam, said joist member for being receivably held by a pair of ledger members; and, (h) a frame member removably attached to one of said main leg, or said outside leg.

* * * * *